US006214163B1

(12) United States Patent
Matsuda et al.

(10) Patent No.: US 6,214,163 B1
(45) Date of Patent: Apr. 10, 2001

(54) SUPER MICROFIBRILLATED CELLULOSE, PROCESS FOR PRODUCING THE SAME, AND COATED PAPER AND TINTED PAPER USING THE SAME

(75) Inventors: Yuji Matsuda, Suntou-gun; Mariko Hirose; Katsuhiko Ueno, both of Mishima, all of (JP)

(73) Assignee: Tokushu Paper Mfg. Co., Ltd., Shizuoka (JP)

( * ) Notice: Subject to any disclaimer, the term of this patent is extended or adjusted under 35 U.S.C. 154(b) by 0 days.

(21) Appl. No.: 09/641,955

(22) Filed: Aug. 21, 2000

Related U.S. Application Data

(62) Division of application No. 08/886,262, filed on Jul. 1, 1997.

(51) Int. Cl.[7] ..... D21H 11/16

(52) U.S. Cl. ..... 162/9; 162/28; 162/100; 162/129; 162/130; 162/135; 162/162

(58) Field of Search ..... 162/9, 100, 176, 162/187, 162, 28, 135, 129, 130; 427/391, 395

(56) References Cited

U.S. PATENT DOCUMENTS 4,374,702 2/1983 Turbak et al. .
5,487,419 1/1996 Weibel .

FOREIGN PATENT DOCUMENTS 60-19921 5/1985 (JP) .
4-82907 3/1992 (JP) .
4-194097 7/1992 (JP) .
6-10286 1/1994 (JP) .
7-310296 11/1995 (JP) .
7-324300 12/1995 (JP) .
8-284090 10/1996 (JP) .

*Primary Examiner*—Peter Chin
(74) *Attorney, Agent, or Firm*—Wenderoth, Lind & Ponack, L.L.P.

(57) ABSTRACT

A super microfibrillated cellulose having an arithmetic average fiber length of 0.05 to 0.1 mm, a water retention value of at least 350%, a rate of the number of fibers not longer than 0.25 mm of at least 95% based on the total number of the fibers as calculated by adding up, and an axial ratio of the fibers of at least 50. The super microfibrillated cellulose is produced by passing a slurry of a previously beaten pulp through a rubbing apparatus having two or more grinders which are arranged so that they can be rub together to microfibrillate the pulp to obtain microfibrillated cellulose and further super microfibrillate the obtained microfibrillated cellulose with a high-pressure homogenizer to obtain the super microfibrillated cellulose. A coated paper produced with a coating material containing the super microfibrillated cellulose, and a tinted paper produced from a paper stock containing the super microfibrillated cellulose as a carrier carrying a dye or pigment are also provided.

10 Claims, 1 Drawing Sheet

SUPER MICROFIBRILLATED CELLULOSE, PROCESS FOR PRODUCING THE SAME, AND COATED PAPER AND TINTED PAPER USING THE SAME

This is a divisional of Ser. No. 08/886,262, filed Jul. 1, 1997.

BACKGROUND OF THE INVENTION

The present invention relates to a super microfibrillated cellulose obtained by microfibrillating cellulose fibers and further microfibrillating the obtained microfibrillated cellulose to a predetermined fineness, and a process for producing the super microfibrillated cellulose.

The present invention relates also to a process for producing a coated paper and a process for producing a tinted paper, taking advantage of properties peculiar to the super microfibrillated cellulose.

When cellulose fibers such as wood pulp are microfibrillated, the fibers are divided to form fibrils which are the constituting units of the cell membranes and, therefore, the microfibrillation proceeds by branching while the fiber shape is kept to form the microfibrillated cellulose. It is known that when such a microfibrillated cellulose is added to a papermaking pulp, a paper having various interesting properties is obtained. For example, when the microfibrillated cellulose is added to a paper stock, an effect of improving the strength including tensile strength and bursting strength and also an effect of increasing the air permeability are obtained. In addition, the capacity of retaining the filler and the adsorption of a dye are also improved by the microfibrillated structure of the cellulose.

It has hitherto been known that the microfibrillated cellulose can be obtained by applying a strong mechanical shearing force to cellulose fibers such as a papermaking pulp, and various processes for producing such a microfibrillated cellulose have been proposed. For example, Japanese Patent Publication No. 60-19921/1985 (corresponding to U.S. Pat. No. 4374702 issued Feb. 22, 1983) proposes a process for producing microfibrillated celluloses, which comprises a step of passing a suspension of a fibrous cellulose through a small-diameter orifice in which the suspension is subjected to a pressure drop of at least 3,000 psi and a high velocity shearing action followed by a high velocity decelerating impact, and a step of repeating this step until the cellulose suspension becomes a substantially stable suspension.

Japanese Patent Laid-Open No. 4-82907/1992 proposes a process for producing a fibrillated natural cellulose by breaking short fibers of natural cellulose in a dry state.

Further, Japanese Patent Laid-Open No. 6-10286/1994 discloses a process for producing microfibrillated cellulose by wet pulverization treatment of a fibrous cellulose suspension with a vibration mill containing glass, alumina, zirconia, zircon, steel or titania beads or balls as a pulverizing medium.

The above-described process proposed in Japanese Patent Publication No. 6-19921/1985 wherein the suspension of a fibrous material such as a pulp must be passed through a small-diameter orifice under a high pressure has a problem of the treatment efficiency that the solid concentration of the suspension to be processed must be kept as low as 1% by weight or below, since when a suspension having a solid concentration of above 1% by weight is passed through the small-diameter orifice, the orifice tends to be clogged. When the microfibrillated cellulose of a high concentration is to be obtained by concentrating the treated suspension having a low solid concentration, the concentration operation becomes laborious. Both the low treatment efficiency and operation efficiency cause an increase in the production cost of the microfibrillated cellulose to pose a problem that the microfibrillated cellulose produced by such a process at a high cost cannot be used for the production of products to be produced at a low cost on a large scale like a paper.

The microfibrillation in a dry state as proposed in the above-described Japanese Patent Laid-Open No. 4-82907/1992 has a problem that the obtained microfibrillated cellulose is in the form of flakes and has a low water retention, since the cellulose fibers are only slightly fibrillated, unlike those microfibrillated by the wet process.

In the wet grinding process proposed in Japanese Patent Laid-Open No. 6-10286/1994 wherein the vibration mill is used, a very long time is necessitated for the microfibrillation treatment of long fibers such as conifer fibers or non-wood fibers and, even in the treatment of short fibers such as broadleaf tree fibers, the separation of the obtained microfibrillated cellulose from beads or balls used as the pulverizing medium is difficult, since the microfibrillated cellulose thus obtained is sticky and, therefore, this process has problems in the treatment efficiency.

A process for producing a microfibrillated cellulose by solving the above-described problems has been proposed by the assignee of the present invention in Japanese Patent Laid-Open No. 7-310296/1995. This process is characterized by passing a slurry of a previously beaten pulp through a rubbing part of a rubbing apparatus comprising two or more grinders each comprising abrasive grains having a grain size of No. 16 to 120 to microfibrillate the pulp and thereby to obtain microfibrillated cellulose having an arithmetic average fiber length of 0.05 to 0.3 mm, a water retention value of at least 250%, and a rate of the number of fibers not longer than 0.5 mm of at least 95% based on the total number of the fibers as calculated by adding up. This process has an advantage that even when the solid concentration is as relatively high as about 5 to 6% by weight, the microfibrillation treatment can be efficiently conducted, since the pulp in the slurry to be fed into the rubbing apparatus has been previously beaten.

Not only the various production processes described above but also the uses of the microfibrillated cellulose have been already developed. Japanese Patent Laid-Open No. 4-194097/1992 proposes a coated paper produced by adding the microfibrillated cellulose to a coating material for size press or the like and then coating at least one surface of a paper with the coating material. However, according to our tests wherein the microfibrillated cellulose was added to a coating material comprising starch and other ingredients and the obtained coating material was applied to a paper to form a coated paper, it was found that this process has problems that the coating material was thickened, that the microfibrillated cellulose aggregated to some extent to make the uniform coating impossible and to realize a foreign matter feeling or to form a streak trouble and to cause faults in the coating, and that the printability of the coated paper is impaired. After intensive investigations made for the purpose of finding the causes of the problems, we have found that the fiber length distribution of the microfibrillated cellulose is improper and that the water retention value is excessively low.

In Japanese Patent Laid-Open No. 7-324300/1995 the assignee of the present invention previously proposed a process for producing a tinted paper by adding a carrier carrying a dye or pigment, prepared by supporting the dye or pigment on a microfibrillated cellulose, to a paper stock prepared mainly from a papermaking pulp and manufacturing paper from the resultant mixture. It was found that even by this process, the level tinting is impossible when microfibrillated cellulose having a size larger than a predetermined size is contained in the mixture, and the tinted paper product having a very fine, unevenly dyed portions is obtained.

SUMMARY OF THE INVENTION

Under these circumstances, an object of the present invention is to provide a microfibrillated cellulose suitable for being added to a coating material used particularly for the production of a coated paper and also for being used as a carrier for a dye or pigment for the production of a tinted paper.

Another object of the present invention is to provide a process for efficiently producing a microfibrillated cellulose suitable for the above-described uses.

After intensive investigations made for the purpose of attaining the above-described objects, we have found that a product (hereinafter referred to as "super microfibrillated cellulose") obtained by further microfibrillating a microfibrillated cellulose to a predetermined degree is suitable for use as an additive for a coating material for the production of a coated paper and also as a carrier for a dye or pigment for the production of a tinted paper. The present invention has been completed on the basis of this finding.

Namely, the super microfibrillated cellulose of the present invention has an arithmetic average fiber length of 0.05 to 0.1 mm, a water retention value of at least 350%, a rate of the number of fibers not longer than 0.25 mm of at least 95% based on the total number of the fibers as calculated by adding up, and an axial ratio (length/width) of the fiber of at least 50.

The super microfibrillated cellulose can be produced basically by further super microfibrillating a microfibrillated cellulose, obtained by the process proposed in Japanese Patent Laid-Open No. 7-310296/1995 wherein the rubbing apparatus comprising grinders is used, with a high-pressure homogenizer.

Namely, the process of the present invention for producing a super microfibrillated cellulose comprises passing a slurry of a previously beaten pulp through a rubbing part of a rubbing apparatus comprising two or more grinders each comprising abrasive grains having a grain size of No. 16 to 120 to microfibrillate the pulp and thereby to obtain microfibrillated cellulose, and further super microfibrillating the obtained microfibrillated cellulose with a high-pressure homogenizer to obtain super microfibrillated cellulose having an arithmetic average fiber length of 0.05 to 0.1 mm, a water retention value of at least 350%, a rate of the number of fibers not longer than 0.25 mm of at least 95% based on the total number of the fibers as calculated by adding up, and an axial ratio of the fiber of at least 50.

The super microfibrillated cellulose of the present invention has properties particularly suitable for being added to a coating material for the production of a coated paper or suitable for use as a carrier for a dye or pigment used for the production of a tinted paper. Taking advantage of these properties, a coated paper having a printability superior to that of a coated paper produced by using a conventional microfibrillated cellulose and also a uniformly tinted paper can be produced.

Namely, the process of the present invention for producing a coated paper, taking advantage of the properties of the super microfibrillated cellulose, comprises coating at least one surface of a base paper with a coating material containing the super microfibrillated cellulose. The thus produced coated paper comprises the base paper and the coating layer formed on at least one surface of the base paper, and the coating layer contains the super microfibrillated cellulose.

Further, the process of the present invention for producing a tinted paper, taking advantage of the properties of the super microfibrillated cellulose, comprises supporting a dye or pigment on the super microfibrillated cellulose to form a carrier carrying the dye or pigment, adding the carrier carrying the dye or pigment to a paper stock prepared mainly from a papermaking pulp, and manufacturing paper from the resultant mixture. The thus produced tinted paper comprises paper manufactured mainly from papermaking pulp, and the carrier carrying the dye or pigment are uniformly dispersed in the paper.

Although various processes for producing microfibrillated celluloses and the uses thereof have been proposed hitherto, the super microfibrillated cellulose obtained by further microfibrillating these microfibrillated cellulloses to the degree given in the present invention has not been disclosed so far, and the concrete process for producing it or the uses thereof have never been proposed.

PREFERRED EMBODIMENTS OF THE INVENTION

Figure 1:
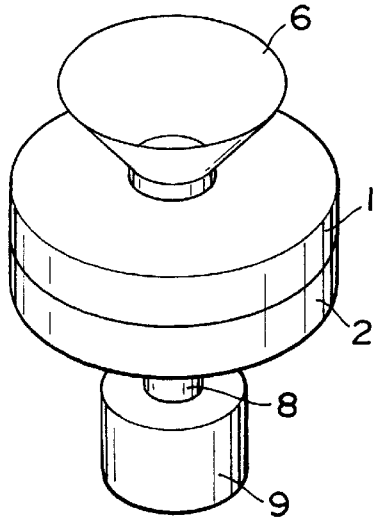
FIG. 1 is a perspective view showing an example of the rubbing apparatus comprising grinders used for the production of the super microfibrillated cellulose of the present invention.

The detailed description will be given below on the process of the present invention for producing the super microfibrillated cellulose. As described above, the step of producing the microfibrillated cellulose with the rubbing apparatus comprising two or more grinders is the same as that in the process for producing the microfibrillated cellulose described in Japanese Patent Laid-Open No. 7-310296/1995. When a slurry of a long fiber pulp which has not been previously beaten is microfibrillated even in the rubbing apparatus comprising the grinders, the dehydration occurs at first in the rubbing part of the apparatus because of a low water retention of the fibers, and the concentration of the microfibrillated product discharged from the apparatus is far lower than that of the introduced pulp slurry to make the treatment efficiency low. On the contrary, when a slurry of the previously beaten pulp is microfibrillated in the rubbing apparatus comprising the grinders, the microfibrillation can be conducted while the solid concentration of the pulp slurry is kept as high as 6% by weight or below and the microfibrillated cellulose having a high water retention value and a uniform fiber length distribution can be efficiently obtained in a relatively short time.

The degree of beating in the previous beating treatment can be divided into two groups depending on kind of the pulp used as the starting material. The pulps in one group are long fiber pulps having an arithmetic average fiber length of at least 0.8 mm. In this case, the pulp is previously beaten to obtain a freeness of not higher than 400 ml CSF and then introduced into the rubbing apparatus. The pulps include those obtained by extracting fibers from woods of conifers such as Japanese conifers, e.g. Yezo spruce, Todo fir, Japanese red pine and Japanese larch and foreign conifers, e.g. black spruce, white spruce, Douglas fir, Western hemlock, Southern pine and Jack pine by a mechanical or chemical method. These pulps include also those extracted from non-wood fibers typified by cotton pulps, hemp, bagasse, kenaf, esparto, Kozo, Mitsumata, and Ganpi. The non-wood fibers include also regenerated celluloses such as rayon, Tencel and polynosics.

The pulps in the other group are short fiber pulps having an arithmetic average fiber length of shorter than 0.8 mm. They are previously beaten to a freeness of not higher than 600 ml CSF. The pulps include those obtained by extracting fibers from woods of broadleaf trees such as Japanese broadleaf trees, e.g. Japanese linden, basswood, poplar and birch, and foreign broadleaf trees, e.g. aspen, cottonwood, black willow, yellow poplar, yellow birch and eucalyptus by a mechanical or chemical method. These pulps include also those obtained by shortening the fibers of some non-wood fibers and regenerated celluloses by a mechanical method.

The process for producing the pulp usable as the starting material for the super microfibrillated cellulose of the present invention is not limited, and pulps produced by any process are usable. The pulps usable herein include those produced by a mechanical process such as GP, PGW, RGP, TMP, CTMP, SCP and CGP, and those produced by a chemical process such as KP and SP. Pulps usable herein also include those produced by a special pulping process such as anthraquinone cooking process, Alcaper process, exploded process, biomechamical pulping process, organosolve pulping process or hydrotropic pulping process.

In the pretreatment, i.e. previous beating, an ordinary beating machine used hitherto for manufacturing paper is usable. Examples of the beating machines include a beater, Jordan, conical refiner, single disc refiner and double disc refiner.

Since the treatment efficiency of the beating machine as describe above is very high, the freeness of the pulp is preferably made as low as possible in the previous beating treatment wherein the above-described beating machine is used. Preferably, the freeness of both long fiber pulp and short fiber pulp is previously made not higher than 300 ml CSF.

Figure 2:
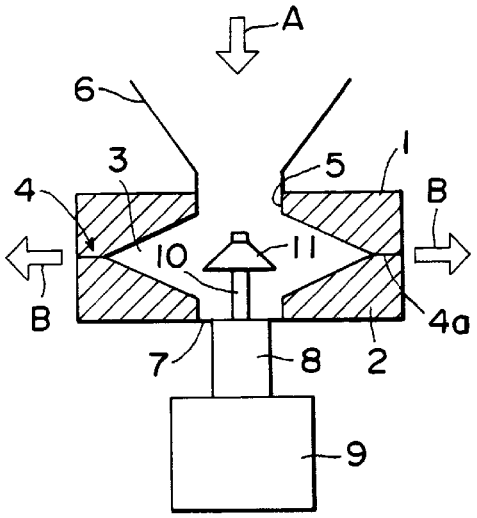
FIG. 2 is a cross section of the apparatus shown in FIG. 1.

An example of the rubbing apparatus comprising the grinders and used in the steps of producing the microfibrillated cellulose in the present invention is schematically shown in FIGS. 1 and 2. The apparatus shown In FIGS. 1 and 2 is provided with an upper fixed grinder 1 and a lower rotating grinder 2 which are arranged so that they can rub together. The inner surfaces of the two opposite grinders are tapered toward the center of each grinder to form a space, i.e. grinding chamber 3. The surrounding flat surfaces 4*a* of the two grinders are brought into contact with each other to form a rubbing part 4. A hopper 6 is arranged above a central opening 5 of the fixed grinder 1 so that the bottom of the hopper 6 is connected with the grinding chamber 3. The central opening of the rotating grinder 2 is blocked with a blocking plate 7. The rotating grinder 2 is operated with a driving motor 9 through a shaft 8 extending downward below the lower side of the grinder 2. An umbrella-type current plate 11 is arranged substantially at the center of the grinding chamber 3 by a supporting rod 10 extending upward from the blocking plate 7 of the rotating grinder 2.

Figure 3:
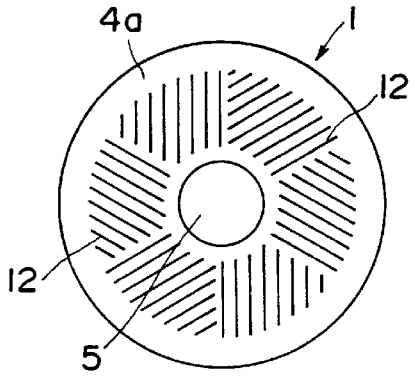
FIG. 3 is a plan of an example of the grinders used in the apparatus shown in FIG. 1.

FIG. 3 shows the inner side of the fixed grinder 1, wherein feed grooves 12 are formed substantially radially from the central opening 5 on the tapered surface forming the grinding chamber 3. The feed grooves 12 are not formed on the surrounding flat surface 4a which forms the rubbing part. The shape and number of the feed grooves 12 are not necessarily limited to those as shown in FIG. 3.

The microfibrillation with this apparatus is conducted as described below. When the slurry of the pulp previously beaten is fed into the hopper 6 (see arrow A in FIG. 2), the pulp slurry flows downward, and it is radially dispersed by the current plate 11 and uniformly fed into the grinding chamber 3. In the grinding chamber 3, the pulp slurry is fed into the rubbing part 4, formed by the grinding discs 1 and 2, by the centrifugal force of the rotating grinder 2 and also by the function of the feed grooves 12 on the inner surface of the grinding chamber 3. The pulp is microfibrillated by the rubbing function of the upper and lower grinders in the rubbing part 4. The slurry of thus formed microfibrillated cellulose is discharged through the periphery of the grinders 1 and 2 by the centrifugal force (see arrow B in FIG. 2). The discharged slurry of the microfibrillated cellulose can be recirculated into the hopper 6 to be further microfibrillated until the desired microfibrillated cellulose is obtained.

The grinder of the rubbing apparatus is produced by bonding abrasive grains with a bonding material. The materials of the abrasive grains include those ordinarily used hitherto such as natural ones, e.g. diamond, corundum and emery, and artificial ones, e.g. synthetic diamond, cubic boron nitride crystals, alumina, silicon carbide and boron carbide. When a porous ceramic is used as the abrasive grains, it is desirable to previously fill up the pores of the porous ceramic with a synthetic resin or the like, since the microfibrillated cellulose would penetrate into the pores to propagate bacteria.

The abrasive grains employed for producing the grinders of the rubbing apparatus used in the present invention must have a grain size of No. 16 to 120 as specified in JIS R 6001. After the investigations on the microfibrillation effect of abrasive grains having a grain size ranging from No. 5 to No. 240 successively on the pulp slurry, we have found that when the coarse abrasive grains having a grain size smaller than No. 16 are used, the intended microfibrillation and uniformity cannot be attained even after conducting the microfibrillation for a long time, and that when the fine abrasive grains having a grain size larger than No. 120 are used, the rubbing part of the grinder is easily clogged to make the discharge of the microfibrillated pulp slurry difficult. Therefore, the size of the abrasive grains is limited to No. 16 to 120, preferably No. 24 to 80.

The very rough surface of each grinder composed of the properly fine abrasive grains to form micro projections on the grinding surface of the grinder contributes largely to the efficient microfibrillation of the pulp by the rubbing of the grinders. The microfibrillation proceeds when a strong shearing force is applied to the pulp fibers on the projections formed by the abrasive grains. Since the projections spread all over the rubbing surfaces of the grinders, the cell walls of the pulp fibers are efficiently divided to form the separate fibrils. Since the microfibrillation mechanism of the pulp fibers is as described above, the grinders having any structure can be used so far as they are arranged to be rubbed together, and the structure is not necessarily limited to that shown in FIGS. 1 and 2. The structure of the feeder for feeding the pulp slurry into the rubbing part of the grinders is not limited to that shown in FIGS. 1 and 2, and various other structures in which centrifugal force, gravity, pressure pump or the like is employed are possible. The number of the grinders is not limited to two, and an apparatus wherein three or more grinders are rubbed together is also usable.

In the steps of producing the microfibrillated cellulose in the present invention, the solid concentration of the pulp slurry to be fed into the rubbing apparatus exerts an influence on the microfibrillation efficiency. When the solid concentration is excessively high, the operation load applied to the rubbing apparatus becomes excessively high, the passing of the pulp through the rubbing part becomes difficult, and finally the pulp is scorched by the heat generated in the rubbing part unfavorably. In the present invention wherein the pulp in the slurry is beaten previous to the feeding into the rubbing apparatus, the pulp slurry smoothly passes through the rubbing part even when the solid concentration of the slurry is around 6% by weight. The optimum solid concentration is, however, around 4% by weight. The solid concentration of the pulp slurry in the step of producing the microfibrillated cellulose in the present invention can be remarkably high, while the solid concentration of the pulp slurry which can be passed through the small-diameter orifice without clogging it was around 1% by weight in the prior art process for producing the microfibrillated cellulose using an ordinary high-pressure homogenizer. Therefore, the efficient microfibrillation treatment is possible in the present invention.

In the present invention, the microfibrillated cellulose thus obtained with the rubbing apparatus is further super microfibrillated with a high-pressure homogenizer. The super microfibrillation with the high-pressure homogenizer is attained by passing a suspension of a microfibrillated cellulose through a small-diameter orifice under a high pressure and then subjecting the cellulose to a high-velocity decelerating impact to apply a shearing force to the microfibrillated cellulose. By repeating such a super microfibrillation step, a stable super microfibrillated cellulose suspension is obtained. In the super microfibrillation step of the present invention, any high-pressure homogenizer operated according to the above-described principle is usable. For example, apparatus available on the market under a trade name of "Nanomizer" (a product of Nanomizer Co., Ltd.) or "Microfluidizer" (a product of Microfluidics Co., Ltd.) is usable.

Figure 4:
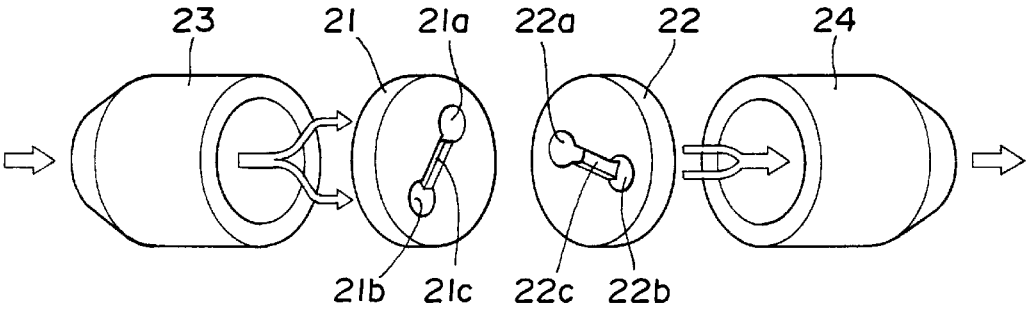
FIG. 4 is a conceptual drawing showing an example of the high-pressure homogenizer used for the production of the super microfibrillated cellulose of the present invention.

FIG. 4 is a conceptual drawing of an embodiment of the high-pressure homogenizer used in the super microfibrillation step. Two discs, i.e. a front disc 21 and a rear disc 22, are brought into close contact with each other by means of outer cylindrical pressers 23 and 24. In FIG. 4, these discs and members are shown separately from each other so that the inner surfaces of the front disc 21 and rear disc 22 can be seen, while they are brought into contact with each other when they are fastened. Each disc has two through holes 21*a* and 21*b*, and 22*a* and 22*b*, and the inner surface of each disc has a groove 21*c* or 22*c* which connects the two through holes. The width of the groove is smaller than the diameter of the through hole. The two discs are arranged in such a manner that the groove 21*c* of the front disc 21 and the groove 22*c* of the rear disc 22 are arranged with the inner surface inside so that an angle of 90*x* is formed between the grooves 21*c* and 22*c* or a cross is formed by the grooves 21*c* and 22*c*.

The aqueous suspension of the microfibrillated cellullose obtained in the rubbing apparatus is then compressed with a pump and sent into a high-pressure homogenizer through a pressure pipe (not shown) for sending the material under a superhigh pressure of several hundred kg/cm$^2$ or above, and it reaches the outer surface of the front disc 21 through the cylindrical presser 23 on the front side. The material is divided into two parts by the through holes 21*a* and 21*b* of the front disc, accelerated and passed through the disc 21. The fibers of the material flow at a higher speed toward the center in an orifice formed by the groove 21*c* and the flat inner surface of the rear disc 22, and the fibers collide with each other at the center and whereby they are super microfibrillated. Then the stream flows through an orifice formed by the groove 22*c* of the disc 22 arranged at an angle of 90° and the flat inner surface of the front disc 21, and it is divided into two parts which are passed through the through holes 22*a* and 22*b* and discharged as the super microfibrillated cellulose suspension through the cylindrical presser member 24 on the rear side.

The degree of the super microfibrillation of the microfibrillated cellulose and that of the homogenization of the suspension vary depending on the feeding pressure into the high- pressure homogenizer and the number of times of passing through the high- pressure homogenizer. Although a feeding pressure in the range of 500 to 2,000 kg/cm$^2$ is suitable for the super microfibrillation, a pressure in the range of 1,000 to 2,000 kg/cm$^2$ is preferred from the viewpoint of the productivity.

The super microfibrillated cellulose of the present invention having an arithmetic average fiber length of 0.05 to 0.1 mm, a water retention value of at least 350%, a rate of the number of fibers not longer than 0.25 mm of at least 95% based on the total number of the fibers as calculated by adding up, and an axial ratio of the fiber of at least 50 can be obtained by the step of previously beating the pulp with the beating machine, step of producing the microfibrillated cellulose with the rubbing apparatus comprising the grinders and step of the super microfibrillation with the high-pressure homogenizer as described above. These steps can be conducted continuously or the respective steps can be conducted independently from each other.

When the super microfibrillated cellulose is to be produced only with the high-pressure homogenizer without the rubbing apparatus comprising the grinders, the solid concentration of the starting pulp slurry to be fed under pressure into the high-pressure homogenizer must be reduced to as low as 1% by weight or below in order to prevent the orifice from the clogging and, in addition, the number of times of passing the microfibrillated cellulose through the high-pressure homogenizer must be at least 10. As a result, the production cost becomes high and, therefore, the product cannot be used as an additive for paper.

The arithmetic average fiber length defined in the present invention is determined by calculating the total length of the whole fibers contained in a predetermined pulp suspension among data obtained with a fiber length analyzer (FS-200) (a product of KAJAANI, Finland) and then dividing the total length by the number of the fibers. The ratio of the numbers of the fibers added up can also be obtained with the same analyzer. LBKP and NBKP which are ordinary materials for paper have an arithmetic average fiber length of about 0.5 mm and 1 mm, respectively. The arithmetic average fiber length of even the fibrillated fibers obtained after beating is at least about 0.35 mm. The microfibrillated cellulose produced with the rubbing apparatus comprising the grinders has an arithmetic average fiber length of 0.05 to 0.3 mm and a rate of the number of fibers not longer than 0.5 mm of at least 95% based on the total number of the fibers as calculated by adding up. On the other hand, the super microfibrillated cellulose produced by the present invention is more microfibrillated than those described above, i.e. this cellulose has an arithmetic average fiber length of 0.05 to 0.1 mm and a rate of the number of the fibers not longer than 0.25 mm of at least 95% based on the total number of the fibers as calculated by adding up.

The water retention value is an index of the degree of swelling of the pulp. This value is determined on the basis of an idea that the water kept within the swollen fibers can be differentiated from free water contained in the fibers and among the fibers by a proper centrifugal power. The water retention value defined herein is determined by previously forming a mat from a predetermined amount of the sample on a predetermined filter, dehydrating the mat at a centrifugal force of 3,000 G with a centrifugal separator for 15 minutes and dividing the quantity of water kept therein by the amount of the absolute dry weight of the pulp according to a method described in JAPAN TAPPI No. 26, on the basis of the similar idea as described above. The water retention value of an ordinary pulp before the beating is around 90%, and that of even the beaten pulp is only about 200%. The microfibrillated cellulose produced with the rubbing apparatus comprising the grinders has a water retension value of at least 250%. It is to be noted that the super microfibrillated cellulose produced by the present invention has a water retention value of at least 350%. This lower limit of the water retention value of the present invention is higher than those obtained in the prior art.

The axial ratio (length/width of fiber) was determined by the direct observation with an optical microscope and electron microscope. The super microfibrillated cellulose produced by the present invention has a fiber width of not larger than 1 $\mu$m and the shortest fiber length of around 50 $\mu$m and, therefore, the lowest axial ratio is 50 or, in other words, the axial ratio is at least 50. The super microfibrillated cellulose of the present invention having such an axial ratio can be clearly distinguished from powdery cellulose having a low axial ratio.

The description will be made on the process for producing a coated paper, taking advantage of the properties of the super microfibrillated cellulose of the present invention. The super microfibrillated cellulose of the present invention is capable of improving the on-machine coating properties of a coating material in a drying zone of a paper machine when it is added to the coating material to be applied with a size press machine, gate roll coating machine or bill blade coating machine. The super microfibrillated cellulose is also capable of improving the coating properties of an off-machine coating material when it is added to the coating material. In addition, when the coating material containing the super microfibrillated cellulose is applied to one or both surfaces of a base paper, properties, particularly printability, of the paper can be improved.

Utilization Examples for On-machine Coating Material

1) Addition to surface-sizing coating material: Usually 0.1 to 10% by weight of the super microfibrillated cellulose is added to a conventionally known coating material such as a styrene resin, styrene/acrylic resin, styrene/maleic acid resin, alkylketene dimer, starch, oxidized starch, hydroxyethylated starch, carboxymethylated cellulose, carboxymethylated guar gum, guar gum phosphate, oxidized guar gum, polyvinyl alcohol or aliacrylamide, and the coating material is used for coating.

2) Addition to coating material for light-weight coated paper: Usually 0.1 to 10% by weight of the super microfibrillated cellulose is added to a conventionally known coating material mainly comprising a filler such as clay, calcium carbonate or kaolin and a binder, and the coating material is used for coating.

Utilization Examples for Off-machine Coating Material

Addition to coating material for coated paper or art paper: Usually 0.1 to 10% by weight of the super microfibrillated cellulose is added to a conventionally known coating material mainly comprising a filler such as clay, calcium carbonate or kaolin and a binder, and the coating material is used for coating.

The reasons why the coating properties of the coating materials can be improved and also why the properties, particularly printability, of the coated paper thus obtained can be improved by adding the super microfibrillated cellulose to them are supposed to be as described below. The coating properties of the coating material can be improved, since the super microfibrillated cellulose of the present invention has excellent water-retaining properties, i.e. a water retention value of at least 350%, and also thixotropic properties. The uniformly coated surface without a feeling caused by foreign matters can be obtained, since the rate of the number of fibers not longer than 0.25 mm is at least 95% based on the total number of the fibers, as calculated by adding up. The bulky coated surface can be obtained, since the axial ratio is at least 50 and, therefore, the printability, particularly ink-absorbency, is improved.

Further, the properties of the super microfibrillated cellulose of the present invention can be utilized for the production of a tinted paper. The tinted paper can be produced by a process proposed by the assignee of the present invention in Japanese Patent Laid-Open No. 7-324300/1995. In this process, a carrier carrying a dye or pigment prepared by supporting the dye or pigment on the super microfibrillated cellulose is mixed in a paper stock comprising a papermaking pulp and paper is manufactured from the resultant mixture. The carrier carrying the dye or pigment is thus adsorbed on the papermaking pulp to tint the paper.

The amount of the carrier carrying the dye or pigment to be added to the stock Is not particularly limited, and is suitably controlled depending on the density of the color required of the resultant tinted paper. Generally it is preferred to add the carrier carrying the dye or pigment in an amount in the range of 0.01 to 10% by weight based on the solid content of the whole starting materials for the paper.

In the preparation of the carrier carrying the dye or pigment by supporting the dye or pigment on the super microfibrillated cellulose, an aqueous solution or aqueous suspension of the dye or pigment is usually added to an aqueous suspension containing about 0.5 to 6% by weight of the super microfibrillated cellulose and the resultant mixture is homogeneously stirred.

The dyes and pigments are those used hitherto for the production of tinted papers, and they are used in the same manner as in a conventional process. The dyes used herein are, for example, basic dyes, acidic dyes, direct dyes, fluorescent dyes, disperse dyes and reactive dyes. The kinds of the pigments are also not limited. Pigments including inorganic pigments mainly comprising a metal oxide or sulfide and organic pigments produced by adding a precipitant to a dissolved dye usually called "lake" to make the dye insoluble are widely usable.

When the carrier for the dye or pigment, which comprises the ordinary microfibrillated cellulose, contains fibers longer than a certain length, the fibers are brought in the paper in the step of making the paper and are visible to cause the uneven dyeing, since the ordinary microfibrillated cellulose tends to be tinted more deeply than a pulp which has not been beaten well. On the contrary, the carrier for the dye or pigment, comprising the super microfibrillated cellulose of the present invention, is so fine that it cannot be seen with naked eyes and, therefore, the unevenness in the dyeing caused by the carrier cannot be recognized. The dispersibility of the carrier for the dye or pigment is also important. Namely, no matter how the primary fibers are fine, the fibers become like thick fibers when the secondary aggregation occurs. After the discussions on this point, we have found that in order to make the macroscopic recognition of the carrier completely impossible, it is necessary that the super microfibrillated cellulose has an arithmetic average fiber length of 0.05 to 0.1 mm, and that the rate of the number of fibers not longer than 0.25 mm is at least 95% based on the total number of the fibers, as calculated by adding up. In addition, the water retention value of the microfibrillated cellulose is closely related to the dispersibility of the carrier for the dye or pigment. Since the super microfibrillated cellulose of the present invention has a water retention value of as high as at least 350%, the carrier is difficultly sedimented or aggregated to make the formation of the paper uniform on wires of the papar machine. This is an excellent effect.

In order to keep the carrier for dye or pigment in the paper, it is important that the carrier is fibrous, and the axial ratio of the fibers must be at least 50. By using the super microfibrillated cellulose of the present invention satisfying these requirements for making the tinted paper, the yield of the dye or pigment can be increased and the level dyeing is made possible. The yield of the dye or pigment relates to the capacity of the super microfibrillated cellulose for adsorbing the dye or pigment. We have also found that the absorbability for the dye or pigment is remarkably improved when the water retention value of the super microfibrillated cellulose is at least 350%.

EXAMPLE

The following Examples and Comparative Examples will further illustrate the present invention. The parts and percentates in the Examples and Comparative Examples are given by absolute dry weight, and both are based on the absolute dry weight.

Example 1

NBKP used as the starting material was previously beaten to 300 ml CSF with a beater to obtain a pulp slurry having a solid concentration of 5%. This product was microfibrillated with a rubbing apparatus (trade name "Supergrinder"; a product of Masuko Sangyo Co., Ltd.; abrasive grain size: No. 46; rotating speed of the rotating grinder: 1,800 rpm, grinder clearance: 20 $\mu$m, hopper capacity: 30 liter) comprising grinders as shown in FIGS. 1 to 3. The treated pulp slurry discharged from the rubbing part the grinders rubbed together is continuously recirculated into the hopper. After the total microfibrillation treatment time of 30 min, the microfibrillated cellulose was obtained.

After controlling the solid concentration of the aqueuos suspension of the microfibrillated cellulose at 3%, the suspension was sent under a high pressure of 1,500 kg/cm$^2$ into a high-pressure homogenizer (trade name: "Nanomizer"; a product of Nanomizer Co., Ltd.) having two discs as shown in FIG. 4 to super microfibrillate the cellulose. This treatment was repeated 5 times to obtain the super microfibrillated cellulose. The properties of the super microfibrillated cellulose thus obtained were examined to obtain the results given in Table 1.

Example 2

The same procedure as that of Example 1 was repeated except that LBKP was used as the starting material to obtain a super microfibrillated cellulose. The properties of the super microfibrillated cellulose thus obtained were examined to obtain the results given in Table 1.

Comparative Example 1

The properties of the microfibrillated cellulose obtained by the previous beating treatment with the beater and the microfibrillation treatment with the rubbing apparatus comprising the grinders in Example 1 were examined to obtain the results given in Table 1.

Comparative Example 2

The properties of the microfibrillated cellulose obtained by the previous beating treatment with the beater and the microfibrillation treatment with the rubbing apparatus comprising the grinders in Example 2 were examined to obtain the results given in Table 1.

Comparative Example 3

The properties of a commercially available microfibrillated cellulose (trade name: "CELISH KY-100S"; a product of Daicel Chemical Industries, Ltd.) were examined to obtain the results given in Table 1.

Comparative Example 4

The properties of a commercially available finely pulverized cellulose (trade name: "Ceolus Cream"; a product of Asahi Chemical Industry Co., Ltd.) were examined to obtain the results given in Table 1.

TABLE 1

| | Ex. | | Comp. Ex. | | | |
|---|---|---|---|---|---|---|
| Item | 1 | 2 | 1 | 2 | 3 | 4 |
| Arithmetic average fiber length (mm) | 0.07 | 0.06 | 0.46 | 0.22 | 0.13. | 0.04 |
| Rate of number of fibers not longer than 0.25 mm (%) | 96 | 97 | 52 | 63 | 72 | 98 |
| Water retention value (%) | 370 | 420 | 280 | 310 | 360 | 460 |
| Axial ratio | 50~300 | 50~150 | 100~1000 | 100~1000 | 100~1000 | 5~15 |

It is understood from the results of Examples 1 and 2 in Table 1 that by using the two apparatuses, i.e. the rubbing apparatus comprising the grinders and high-pressure homogenizer, in this order, the super microfibrillated cellulose having an arithmetic average fiber length of 0.05 to 0.1 mm, a water retention value of at least 350%, a rate of the number of fibers not longer than 0.25 mm of at least 95% based on the total number of the fibers, as calculated by adding up, and an axial ratio of the fibers of at least 50 can be efficiently produced. The microfibrillated cellulose obtained with only the rubbing apparatus comprising the grinders as in Comparative Examples 1 and 2, the commercially available, microfibrillated cellulose used in Comparative Example 3 or the commercially available, finely pulverized cellulose used in Comparative Example 4 cannot have all the properties of the above-described super microfibrillated cellulose.

Example 3

20%, based on the super microfibrillated cellulose, of a red direct dye (C. I. Direct Red 23) was mixed in the aqueous suspension of the super microfibrillated cellulose obtained in Example 1 to obtain a red dye carrier carrying the dye. 5 parts of the carrier carrying the dye and obtained as described above, and 4 parts of aluminum sulfate were added to 95 parts of the solid contained in a paper stock prepared from unbeaten LBKP as the papermaking pulp. A tinted paper having a basis weight of 60 g/m$^2$ was obtained by an ordinary hand making method.

Example 4

A tinted paper was obtained in the same procedure as that of Example 3 except that the super microfibrillated cellulose obtained in Example 2 was used.

Comparative Example 5

A tinted paper was obtained in the same procedure as that of Example 3 except that the microfibrillated cellulose obtained in Comparative Example 1 was used in place of the super microfibrillated cellulose used therein.

Comparative Example 6

A tinted paper was obtained in the same procedure as that of Example 3 except that the microfibrillated cellulose obtained in Comparative Example 2 was used in place of the super microfibrillated cellulose used therein.

Comparative Example 7

A tinted paper was obtained in the same procedure as that of Example 3 except that the commercially available microfibrillated cellulose "CELISH KY-100S", was used in place of the super microfibrillated cellulose used therein.

Comparative Example 8

A tinted paper was obtained in the same procedure as that of Example 3 except that the commercially available, finely pulverized cellulose "Ceolus Cream", was used in place of the super microfibrillated cellulose used therein.

The tinting easiness of the paper, yield of dye and degree of uneven dyeing of the tinted paper obtained in Examples 3 and 4 and Comparative Examples 5 to 8 were examined by the methods described below to obtain the results given in Table 2.

[Tinting easiness]: The results are shown in terms of the values of L*, a* and b* defined in JIS Z 8130. Since the red dye was used, the lower the value of L* and the higher the value of a*, the deeper the color.

[Yield of dye (%)]: The absorbance of the waste liquid obtained by the dehydration in the paper making process was determined, and then converted in terms of the concentration according to a calibration curve previously prepared. The yield of dye was thus calculated according to the following formula:

100—(dye concentration in waste water obtained by hydration)/(concentration of added dye)×100

[Degree of uneven dyeing]: It was determined by macroscopic observation.

TABLE 2

| | Ex. | | Comp. Ex. | | | |
|---|---|---|---|---|---|---|
| Item | 3 | 4 | 5 | 6 | 7 | 8 |
| L* | 56.7 | 56.9 | 58.7 | 58.4 | 57.0 | 59.7 |
| a* | 41.6 | 41.9 | 40.9 | 41.1 | 41.9 | 43.5 |
| b* | 16.2 | 16.1 | 15.8 | 15.6 | 15.9 | 13.7 |
| Yield of dye (%) | 92.5 | 93.6 | 85.4 | 87.6 | 90.3 | 78.7 |
| Degree of even dyeing | uniform | uniform | highly uneven | highly uneven | slightly uneven | uniform |

It can be confirmed from Table 2 that the tinted paper obtained by using the super microfibrillated cellulose of the present invention as the carrier for the dye or pigment has a high yield of the dye and that the color of the sheet of the paper thus produced is deep. In addition, the most serious problem in the tinting, i.e. uneven dyeing, can be solved. Thus, it is understood that the macroscopic recognition of the carrier for dye or pigment becomes impossible when the size of the super microfibrillated cellulose is controlled as in the present invention.

Example 5

0.3 part of sodium hexametaphosphate as a dispersant was added to a mixture of 90 parts of clay and 10 parts of calcium carbonate to obtain a dispersion having a solid concentration of 50%. After obtaining the homogeneous dispersion with an impeller, 5 parts of oxidized starch and 12 parts of SB latex were added to the dispersion and then 3 parts of the super microfibrillated cellulose obtained in Example 1 was added to the resultant mixture to obtain a coating material having a solid concentration of 35%. The coating material was applied to a base paper having a basis weight of 80 g/m$^2$ with a #12 wire bar to obtain the coated paper for printing.

Example 6

A coated paper for printing was obtained in the same procedure as that of Example 5 except that the super microfibrillated cellulose obtained in Example 2 was used.

Comparative Example 9

A coated paper for printing was obtained in the same procedure as that of Example 5 except that the super microfibrillated cellulose was not used.

Comparative Example 10

A coated paper for printing was obtained in the same procedure as that of Example 5 except that the super microfibrillated cellulose was replaced with the commercially available, finely pulverized cellulose "Seorasu Cream".

The viscosity (cps, 20° C.), streak troubles formed in the coating step, evenness of the coating surface, smoothness of the coating surface and printability (dry-down, ink density and dots-gain) of the coating materials obtained in Examples 5 and 6 and Comparative Examples 9 and 10 were examined to obtain the results given in Table 3. These properties were examined by the methods described below.

[Streak troubles in the coating step]: The macroscopic observation was made to find whether a phenomenon of a streak trouble caused by foreign substances contained in the coating material occurs or not in the coating step.

[Evenness of coated surface]: After the coating, the coated surface was macroscopically observed to find whether the coating is made uneven by the non-uniform distribution of the filler, binder, super microfibrillated cellulose, etc.

[Smoothness of the coating surface]: The surface conditions obtained after the coating were examined by the touch.

[Dry-down]: After printing with a blue ink (trade name: TK Hyplus cyan MZ; a product of Toyo Ink Mfg. Co., Ltd.) while the heap amount of the ink was controlled at 1.0 g by means of an RI printing tester (a product of Akari Seisakusho Co., Ltd.), the color density of the ink on the printed surface was determined with a Macbeth densitometer (CRD-914; a product of Macbeth Company) immediately after the printing and also 3 days thereafter. The dry-down was determined from the reduction in the color density according to the following criteria:

◎: 0.10 or below

○: 0.11 to 0.20,

Δ: 0.21 to 0.29, and x : 0.30 or above.

[Ink density]: After printing with the blue ink (TK Hyplus cyan MZ) while the heap amount of the ink was controlled at 1.0 g by means of the RI printing tester, the color density of the ink on the printed surface was determined with a Macbeth densitometer (CRD-914) three days after. The color density was determined according to the following criteria:

◎: 1.60 or above

○: 1.50 to 1.59,

Δ: 1.40 to 1.49, and x : below 1.40.

[Dots-gain]: After conducting a mono-color printing with a Chinese ink (trade name: Graf-G; a product of Dainippon Ink and Chemicals, Ltd.) by means of an offset printing machine (two-color machine R202-OB, a product of Roland Co., Ltd.), the tone value of halftones in a part having a halftone dot area rate of 40% was determined with the Macbeth densitometer (CRD-914). The dots-gain was determined according to the following criteria:

◎: not higher than 2%

○: 2 to 3.9%,

Δ: 4 to 5.9%, and x: above 6%.

TABLE 3

| Item | | Ex. 5 | Ex. 6 | Comp. Ex. 9 | Comp. Ex. 10 |
|---|---|---|---|---|---|
| Viscosity of coating material (cps) | | 650 | 720 | 420 | 1500 |
| Streak trouble formed in coating step | | none | none | none | found |
| Evenness of coating surface | | uniform | uniform | uniform | highly uneven |
| Smoothness of coating surface | | smooth | smooth | smooth | very rough |
| Printability | Dry-down | | ◎ | Δ | X |
| | Ink density | ◎ | ◎ | Δ | Δ |
| | Dots-gain | | ◎ | Δ | X |

It was confirmed that the viscosity of the coating material becomes most suitable for the coating when the super microfibrillated cellulose of the present invention is added in an amount of 3 parts which is effective in realizing the excellent printability as is shown in Table 3. It was also found that by using such an amount of this cellulose, the streak trouble can be prevented and the smoothness is improved. On the contrary, when the commercially available microfibrillated cellulose in the form of a fine powder was used, the viscosity of the coating material became excessively high, the streak troubles were caused in the coating step to reduce the smoothness, and the printability was lowered. When 3 parts of the microfibrillated cellulose obtained in Comparative Examples 1, 2 or 3 were added to the coating material, a foreign matter feeling was realized, since the arithmetic average fiber length of the cellulose was longer than that of the super microfibrillated cellulose of the present invention, and thus the coating became impossible. As for the printability, it was confirmed that when the super microfibrillated cellulose is used, the dry-down, ink density and dots-gain in the course of the printing are superior to those obtained when the super microfibrillated cellulose was not used (Comparative Example 9) or when the commercially available one was used Comparative Example 10.

As described above, the super microfibrillated cellulose of the present invention has an advantage that when it is used in the production of a tinted paper, the yield of the dye is improved and the level dyeing is made possible. When the super microfibrillated cellulose of the present invention is added to a coating material for the production of a coated paper, the coating properties are improved to obtain the level and smooth coating. When the coated paper thus obtained is printed, a remarkable effect that the printability, including the dry-down, ink density and dots-gain, is improved can be obtained, since the coating layer is bulky.

Further, the super microfibrillated cellulose having a uniform fiber length distribution or, in other words, having an arithmetic average fiber length of 0.05 to 0.1 mm, a water retention value of at least 350%, a rate of the number of fibers not longer than 0.25 mm of at least 95% based on the total number of the fibers, as calculated by adding up, and an axial ratio of the fibers of at least 50, can be efficiently produced in the form of a slurry of a high concentration by the present invention wherein the previously beaten pulp is microfibrillated with the rubbing apparatus comprising grinders and the microfibrillated cellulose thus obtained is further super microfibrillated with the high-pressure homogenizer.

What is claimed is:

1. A process for producing a super microfibrillated cellulose, comprising passing a slurry of a previously beaten pulp through a rubbing part of a rubbing apparatus having two or more grinders each composed of abrasive grains having a grain size of No. 16 to 120 to microfibrillate the pulp and thereby to obtain microfibrillated cellulose, and further super microfibrillating the obtained microfibrillated cellulose with a high-pressure homogenizer to obtain super microfibrillated cellulose having an arithmetic average fiber length of 0.05 to 0.1 mm, a water retention value of at least 350%, a rate of the number of fibers not longer than 0.25 mm of at least 95% based on the total number of the fibers as calculated by adding up, and an axial ratio of the fibers of at least 50.

2. A process for producing a super microfibrillated cellulose according to claim 1, wherein said slurry of previously beaten pulp is obtained by beating long fiber pulp having an arithmetic average fiber length of at least 0.8 mm to a freeness of not higher than 400 ml CSF.

3. A process for producing a super microfibrillated cellulose according to claim 1, wherein said slurry of previously beaten pulp is obtained by beating short fiber pulp having an arithmetic average fiber length of shorter than 0.8 mm to a freeness of not higher than 600 ml CSF.

4. A process for producing a super microfibrillated cellulose according to claim 1, wherein the solid concentration of said pulp slurry to be passed through said rubbing part of said rubbing apparatus is 6% by weight or below.

5. A process for producing a super microfibrillated cellulose according to claim 1, wherein said rubbing apparatus is provided with an upper fixed grinder and a lower rotating grinder which are arranged so that they can rub together.

6. A process for producing a coated paper, comprising coating at least one surface of a base paper with a coating material containing a super microfibrillated cellulose having an arithmetic average fiber length of 0.05 to 0.1 mm, a water retention value of at least 350%, the number of fibers not longer than 0.25 mm being at least 95% based on the total number of the fibers, and an axial ratio of the fibers of at least 50.

7. A coated paper comprising a base paper and a coating layer formed on at least one surface of the base paper, said coating layer containing a super microfibrillation cellulose having an arithmetic average fiber length of 0.05 to 0.1 mm, a water retention value of at least 350%, the number of fibers not longer than 0.25 mm being at least 95% based on the total number of the fibers, and an axial ratio of the fibers of at least 50.

8. A process for producing a tinted paper, comprising supporting a dye or pigment on a super microfibrillated cellulose having an arithmetic average fiber length of 0.05 to 0.1 mm, a water retention value of at least 350%, the number of fibers not longer than 0.25 mm being at least 95% based on the total number of the fibers, and an axial ratio of the fibers of at least 50 to form a carrier carrying the dye or pigment, adding the carrier carrying the dye or pigment to a paper stock prepared mainly from a papermaking pulp, and manufacturing paper from the resultant mixture.

9. A process for producing a tinted paper according to claim 8, wherein said carrier carrying the dye or pigment is prepared by adding an aqueous solution or aqueous suspension of the dye or pigment to an aqueous suspension of a super microfibrillated cellulose having an arithmetic average fiber length of 0.05 to 0.1 mm, a water retention value of at least 350%. the number of fibers not longer than 0.25 mm being at least 95% based on the total number of the fibers, and an axial ratio of the fibers of at least 50, and homogeneously stirring the resultant mixture.

10. A tinted paper comprising a paper manufactured mainly from a papermaking pulp, and a carrier carrying a dye or pigment uniformly dispersed in the paper, said carrier carrying the dye or pigment being prepared by supporting the dye or pigment on a super microfibrillated cellulose having an arithmetic average fiber length of 0.05 to 0.1 mm, a water retention value of at least 350%, the number of fibers not longer than 0.25 mm being at least 95% based on the total number of the fibers, and an axial ratio of the fibers of at least 50.

* * * * *